US006971363B2

(12) United States Patent
Aketa et al.

(10) Patent No.: US 6,971,363 B2
(45) Date of Patent: Dec. 6, 2005

(54) ENGINE

(75) Inventors: Masahiro Aketa, Sakai (JP); Tetsuya Kosaka, Sakai (JP); Akira Iwasaki, Sakai (JP)

(73) Assignee: Kubota Corporation, Osaka (JP)

( * ) Notice: Subject to any disclaimer, the term of this patent is extended or adjusted under 35 U.S.C. 154(b) by 85 days.

(21) Appl. No.: 10/238,371

(22) Filed: Sep. 10, 2002

(65) Prior Publication Data

US 2003/0050141 A1 Mar. 13, 2003

(30) Foreign Application Priority Data

Sep. 11, 2001 (JP) ..... P 2001-274537

(51) Int. Cl.[7] ..... F02B 77/00
(52) U.S. Cl. ..... 123/198 R; 123/508
(58) Field of Search ..... 123/195 R, 198 R, 123/470, 195 C, 508, 509

(56) References Cited

U.S. PATENT DOCUMENTS 5,063,897 A 11/1991 Okui et al.
5,083,545 A * 1/1992 Yamashita et al. ..... 123/509
5,983,873 A 11/1999 Dellora et al.
6,286,475 B1 * 9/2001 Pierro ..... 123/195 A

FOREIGN PATENT DOCUMENTS

DE 196 12 405 A1 10/1996
JP 63314359 A * 12/1988 ..... F02M 39/02
JP 11193723 7/1999

* cited by examiner

*Primary Examiner*—Henry C. Yuen
*Assistant Examiner*—Hyder Ali
(74) *Attorney, Agent, or Firm*—Akin Gump Strauss Hauer & Feld, LLP

(57) ABSTRACT

The present invention relates to such an engine as mentioned below.

The engine comprises a belt transmission device (2) which interlockingly operates a cooling fan (1) and a timing transmission device (4) which interlockingly actuates a fuel injection pump (3). The belt transmission device (2) and the timing transmission device (4) are dividedly arranged at a front end and a rear end of a cylinder block (6), respectively. The fuel injection pump (3) is arranged on one horizontal side of the cylinder block (6) and a belt tensioner (7) of the belt transmission device (2) is disposed in front of the fuel injection pump (3).

8 Claims, 5 Drawing Sheets

ENGINE

BACKGROUND OF THE INVENTION

1. Field of the Invention

The present invention relates to an engine.

2. Description of Prior Art

There is a conventional engine provided with a belt transmission device which interlockingly operates a cooling fan and with a timing transmission device which interlockingly actuates a fuel injection pump, like the present invention.

Most of the engines of this type each arrange the belt transmission device and the timing transmission device in layered fashion at one of front and rear ends of a cylinder block. The engines of this type are sorted into a deflected type and a divided type. The engine of the deflected type deflects a belt tensioner of the belt transmission device and the fuel injection pump on one horizontal side of the cylinder block. The engine of the divided type dividedly arranges them on both horizontal sides thereof.

The conventional technique has the following problems.

"Problem 1" The deflected type sometimes enlarges a horizontal width of the engine.

As for the engine in which the belt transmission device and the timing transmission device are arranged in layered fashion at one of the front and rear ends of the cylinder block, the belt tensioner and the fuel injection pump have to be arranged near that one end. Therefore, the engine of the deflected type which deflects them on one horizontal side of the cylinder block cannot arrange them so well that they largely projects from the one horizontal side of the cylinder block to result in sometimes increasing the horizontal width of the engine.

"Problem 2" The engine of the divided type greatly restricts the type of the machine to which it is, loaded.

The engine of the divided type dividedly arranges the belt tensioner and the fuel injection pump, both of which are subjected to frequent maintenance, on horizontal both sides of the cylinder block. This requires the maintenance from the horizontal both sides. Therefore, the engine of this type cannot be loaded to a machine which allows maintenance from only one side to result in restricting the type of the machine to which it is loaded.

SUMMARY OF THE INVENTION

The present invention has an object to provide an engine capable of solving the above-mentioned problems.

An invention as set forth in claim 1 is as follows.

As shown in FIG. 1, an engine is provided with a belt transmission device 2 which interlockingly operates a cooling fan 1 and with a timing transmission device 4 which interlockingly actuates a fuel injection pump 3.

In the above engine, the belt transmission device 2 and the timing transmission device 4 are dividedly arranged at a front end and a rear end of a cylinder block 6, respectively. A fuel injection pump 3 is arranged on one horizontal side of the cylinder block 6. A belt tensioner 7 of the belt transmission device 2 is disposed in front of the fuel injection pump 3.

The invention of claim 1 offers the following effect.

"Effect 1" It is possible to reduce the horizontal width of the engine.

As shown in FIG. 1, the belt tensioner 7 and the fuel injection pump 3 are dividedly arranged in a front and rear direction to result in being able to leave an allowance in the arrangement of them. Thus, as shown in FIGS. 3 and 4, they don't largely project laterally of the cylinder block 6, which leads to the possibility of decreasing the horizontal width of the engine.

"Effect 2" It is possible to loosen the restriction on the type of the machine to which the engine is loaded.

As shown in FIG. 1, the belt tensioner 7 and the fuel injection pump 3 subjected to frequent maintenance are arranged on one horizontal side of the cylinder block 6. Therefore, as for even a machine which allows the maintenance only from one side, if the machine is subjected to the maintenance from the same side as the side where the fuel injection pump 3 and the like are arranged, the engine can be loaded to the machine, which results in the possibility of loosening the restriction on the type of the machine to which the engine is loaded.

The invention of claim 2 offers the following effect.

"Effect 3" The maintenance is conducted in a high working efficiency.

As shown in FIG. 1, the fuel injection pump 3 and a generator 8, which are subjected to frequent maintenance, are arranged on the same side to result in a high working efficiency of the maintenance.

The invention of claim 3 offers the following effect.

"Effect 4" It is possible to inhibit lateral projection of parts at an upper portion on one horizontal side of the engine.

As shown in FIGS. 3 and 4, the fuel injection pump 3, relatively large in horizontal width, is arranged on one horizontal side of an upper side portion 6*a* of the cylinder block 6 where a crank case 15 does not project laterally. This can confine the lateral projection of parts at the upper portion on the one horizontal side of the engine.

The invention of claim 4 offers the following effect.

"Effect 5" It is possible to inhibit lateral projection of every part at a middle portion in a vertical direction on one horizontal side of the engine.

As shown in FIG. 3 or FIG. 4, an oil cooler 9 and a starter motor 5, which are relatively small in horizontal width, are arranged at a position near the crank case 15. This can confine the lateral projection of every part from the mid portion in the vertical direction on the one horizontal side of the engine.

The invention of claim 5 offers the following effect.

"Effect 6" It is possible to effectively utilize a gap space.

As shown in FIG. 1, a gap space between the starter motor 5 and an oil filter 12 can be effectively used as a space for extracting an oil level gauge 16.

The invention of claim 6 offers the following effect.

"Effect 7" It is possible to enhance a working efficiency of the maintenance.

As shown in FIG. 2, a pair of working devices 10, 11 subjected to infrequent maintenance are arranged opposite to the fuel injection pump 3 subjected to frequent maintenance. This makes it possible to arrange a number of parts subjected to frequent maintenance on the side of the fuel injection pump 3 with the result of being able to enhance the working efficiency of the maintenance.

The invention of claim 7 offers the following effect.

"Effect 8" It is possible to make flat an end surface on the other horizontal side of the engine.

As shown in FIGS. 3 and 4, the pair of working devices 10, 11, which become relatively large in width, are arranged on the other horizontal side of the upper side portion 6*a* of the cylinder block 6 where the crank case 15 does not laterally project. This can confine the lateral projection of the working devices 10, 11 from the other horizontal side of the cylinder block 6 and can make flat the end surface on the other horizontal side of the engine.

The invention of claim 8 offers the following effect.

"Effect 9" It is possible to form the whole engine into a shape substantially similar to a compact box.

As shown in FIGS. 3 and 4, the fuel injection pump 3, relatively large in horizontal width, is arranged on one horizontal side of the upper side portion 6*a* of the cylinder block 6 where the crank case 15 does not laterally project. This can confine the lateral projection of parts at the upper portion on the one horizontal side of the engine. Further, the oil cooler 9 and the starter motor 5, relatively small in horizontal width, are disposed at a position near the crank case 15. Thus it is possible to inhibit the lateral projection of every part from the mid portion in the vertical direction of the one horizontal side of the engine. This can make flat the end surface on the one horizontal side of the engine. The pair of working devices 10, 11, which become relatively large in horizontal width, are disposed on the other horizontal side of the upper side portion 6*a* of the cylinder block 6 where the crank case 15 does not laterally project. This can confine the lateral projection of the working devices 10, 11 from the horizontal other side of the cylinder block 6 and make flat the end surface on the horizontal other side of the engine. As such the end surface on the horizontal one side of the engine can be made flat as well as the end surface on the horizontal other side thereof to result in the possibility of forming the whole engine into a shape substantially similar to a compact box.

The invention of claim 9 offers the following effect.

"Effect 10" It is possible to shorten the entire length of the engine.

As shown in FIG. 3, a single fan belt 1*b* can drive a cooling fan pulley 1*a* and a driven pulley 10*a*. This dispenses with the necessity of arranging belts in layered fashion in the front and rear direction with the result of being able to shorten the entire length of the engine.

The invention of claim 10 offers the following effect.

"Effect 11" Notwithstanding the existence of a cooling water introduction pipe, it is possible to shorten the entire length of the engine.

As shown in FIG. 3, even if a cooling water introduction pipe 14*a* exists, the fan belt 1*b* can be arranged while avoiding it. There is no need of arranging them in layered fashion in the front and rear direction to result in the possibility of shortening the entire length of the engine.

The invention of claim 11 offers the following effect.

"Effect 12" It is possible to decrease the number of parts around which the fan belt is wound.

As shown in FIG. 5, no pulley is required for moving part of the fan belt 1*b* away from the cooling fan pulley 1*a* between the tension pulley 7*a* and the driven pulley 10*a*. This can decrease the number of parts around which the fan belt 1*b* is wound.

DESCRIPTION OF THE PREFERRED EMBODIMENTS

Embodiments of the present invention are explained with respect to the attached drawings. FIGS. 1 to 4 explain a first embodiment of the present invention. In this first embodiment, explanation is given for a multi-cylinder vertical diesel engine.

The engine is constructed as follows.

Figure 1:
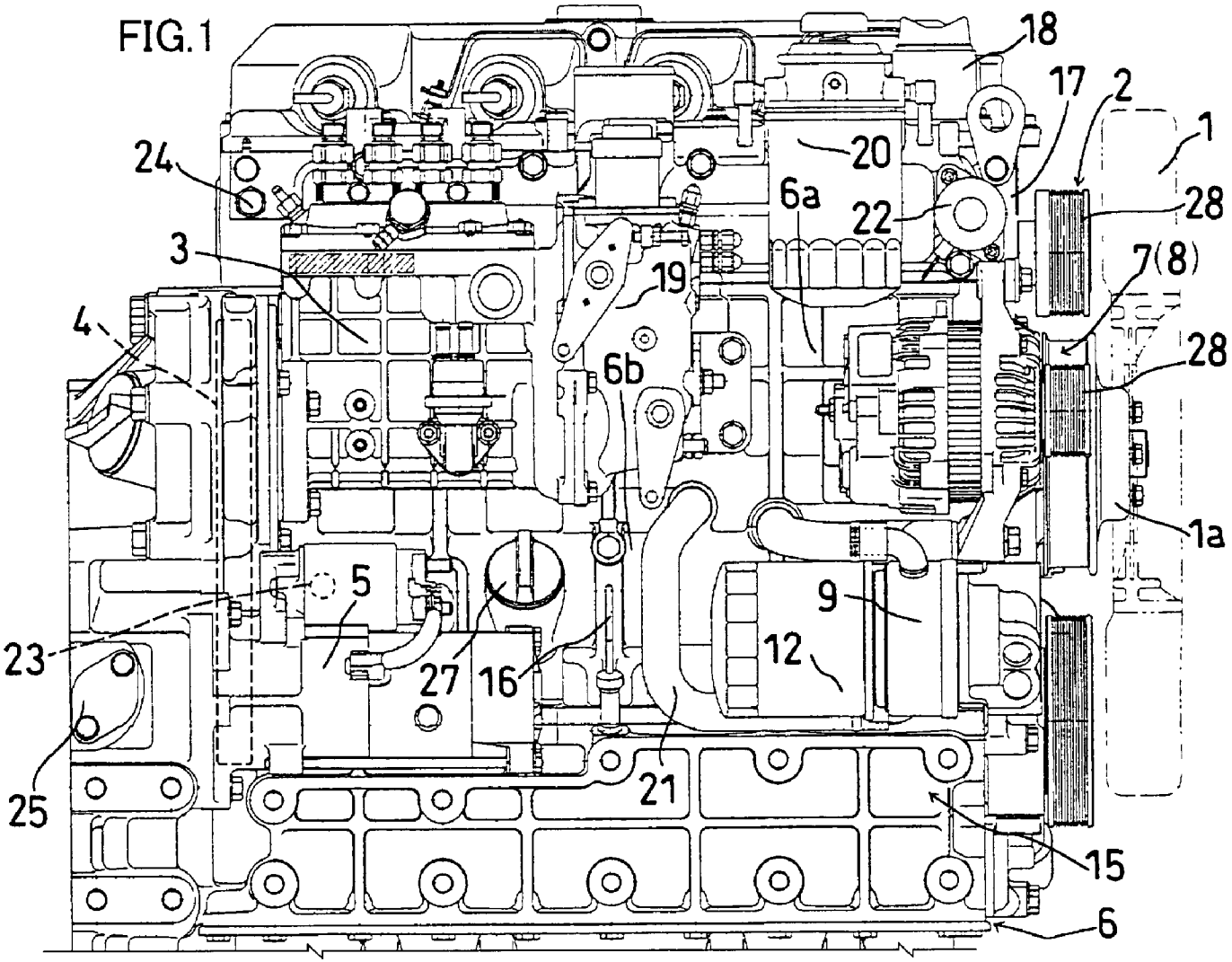
FIG. 1 is a left side view of an engine according to a first embodiment of the present invention.

As shown in FIG. 1, the engine comprises a cylinder block 6, a cylinder head 17 assembled to an upper portion of the cylinder block 6, a head cover 18 assembled to an upper portion of the cylinder head 17, an oil pan (not shown) assembled to a lower portion of the cylinder block 6.

A transmission device is arranged as follows.

As shown in FIG. 1, this engine is provided with a belt transmission device 2 which interlockingly operates a cooling fan 1 and with a timing transmission device 4 which interlockingly actuates a fuel injection pump 3. The belt transmission device 2 and the timing transmission device 4 are dividedly arranged at a front end of the cylinder block 6 and at a rear end thereof, respectively. The timing transmission device 4 is a timing gear train.

On a left side of the engine, principal parts are arranged as follows.

As shown in FIG. 1, a belt tensioner 7 of the belt transmission device 2 and the fuel injection pump 3 are dividedly arranged in a front and rear direction on a left side of the cylinder block 6. The belt tensioner 7 is arranged forwardly and the fuel injection pump 3 is disposed rearwardly. A generator 8 is utilized as the belt tensioner 7. The generator 8 and the fuel injection pump 3 are positioned leftwards of an upper side portion 6*a* of the cylinder block 6 at substantially the same height. An oil cooler 9 and a starter motor 5 are dividedly arranged in the front and rear direction leftwards of a mid portion 6*b* in a vertical direction of the cylinder block 6. The oil cooler 9 is arranged forwardly and the starter motor 5 is disposed rearwardly. The oil cooler 9 and the starter motor 5 are positioned at substantially the same height. When seen from the left side of the cylinder block 6, there is arranged a handle for an oil level gauge 16 between the starter motor 5 and an oil filter 12 attached to a rear portion of the oil cooler 9.

The other parts are arranged on the left side of the engine as follows.

As shown in FIG. 1, a governor 19 is assembled to a front end of the fuel injection pump 3. A fuel filter 20 is arranged leftwards of the cylinder head 17 and upwards of the generator 8. A cooling water pipe 21 of the oil cooler 9 extends from a lower side of the governor 19 to a space between the cylinder block 6 and the oil filter 12. An EGR solenoid valve 22 which controls exhaust gas recirculation amount is arranged leftwards of the cylinder head 17, forwards of the fuel filter 20 and upwards of the generator 8. When seen from the left side of the engine, an oil switch 23 which detects an oil pressure reduction is arranged between the fuel injection pump 3 and the starter motor 5 and a water temperature sensor 24 attached to the cylinder head 17 is disclosed behind the fuel injection pump 3. A fly wheel case 26 is provided with a window 25 for confirming the timing, rearwardly of the starter motor 5. The window 25 confirms a gear matching mark of the timing gear train 4. When seen from the left side of the engine, an oil supply port 27 is arranged downwards of the fuel injection pump 3 and upwards of an end portion near the oil level gauge 16 of the starter motor 5. Since the fuel injection pump 3 is positioned leftwards, as a matter of course, a fuel piping is arranged leftwards. In the case where a reserve reservoir, an air cleaner and an oil drain hole are provided, they are arranged on the left side from which the maintenance is conducted.

Parts are arranged on a right side of the engine as follows.

Figure 2:
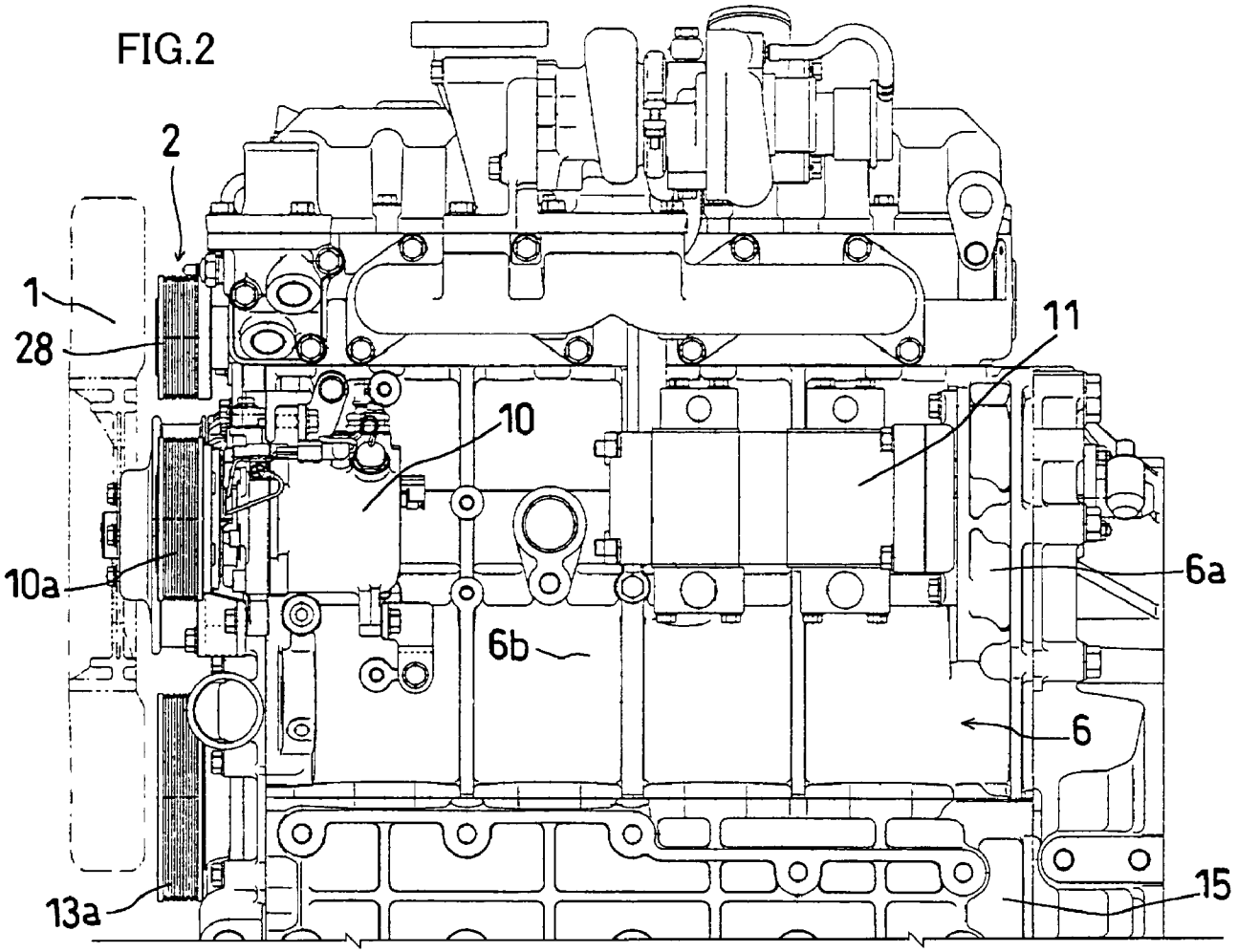
FIG. 2 is a right side view of the engine of FIG. 1.

As shown in FIG. 2, a pair of working devices 10, 11 are dividedly arranged in the front and rear direction on a right side of the upper side portion 6*a* of the cylinder block 6. The front working device 10 is a working air compressor and the rear working device 11 is a working oil pump. These are arranged at substantially the same height.

The belt transmission device is constructed as follows.

Figure 3:
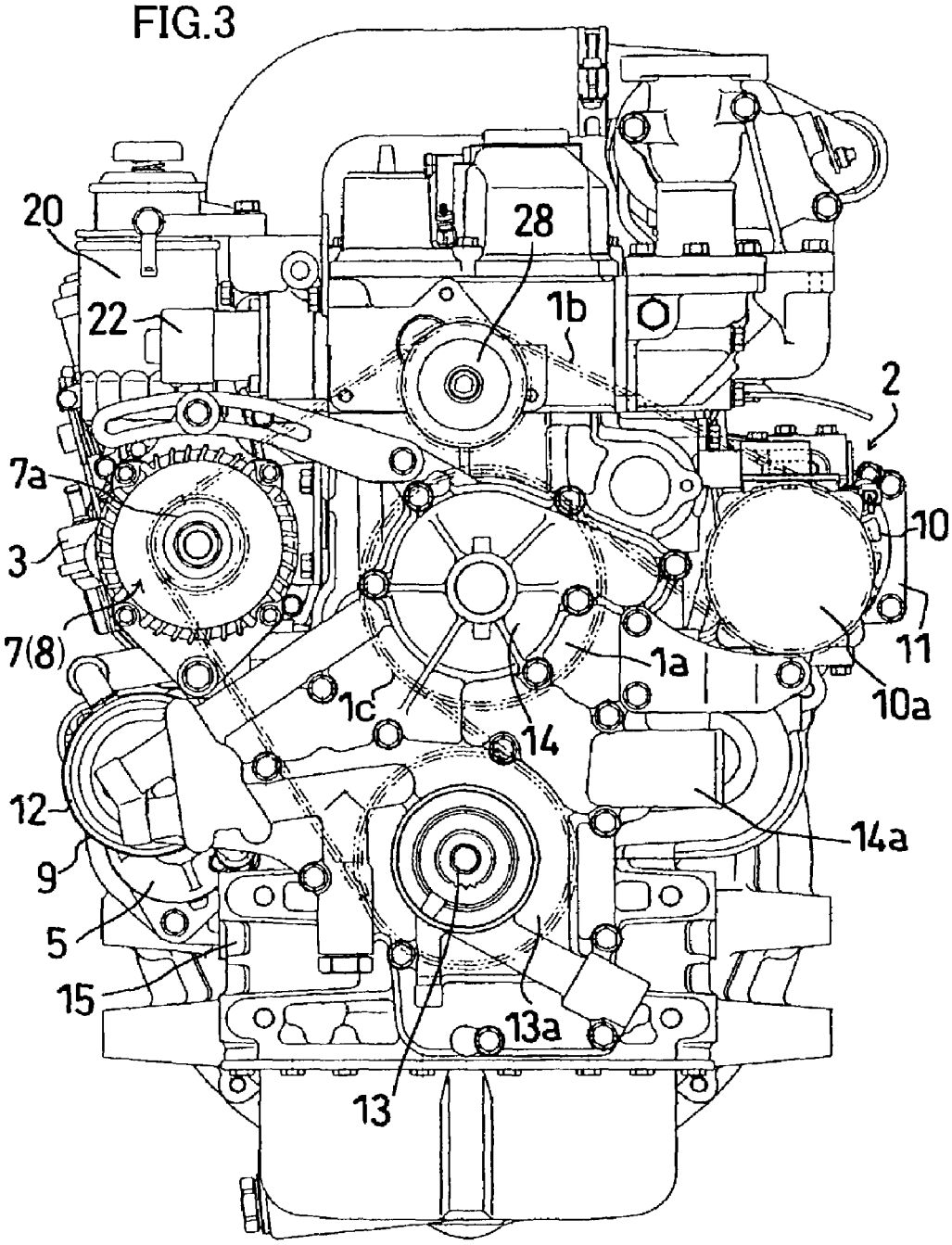
FIG. 3 is a front view of the engine of FIG. 1.
Figure 4:
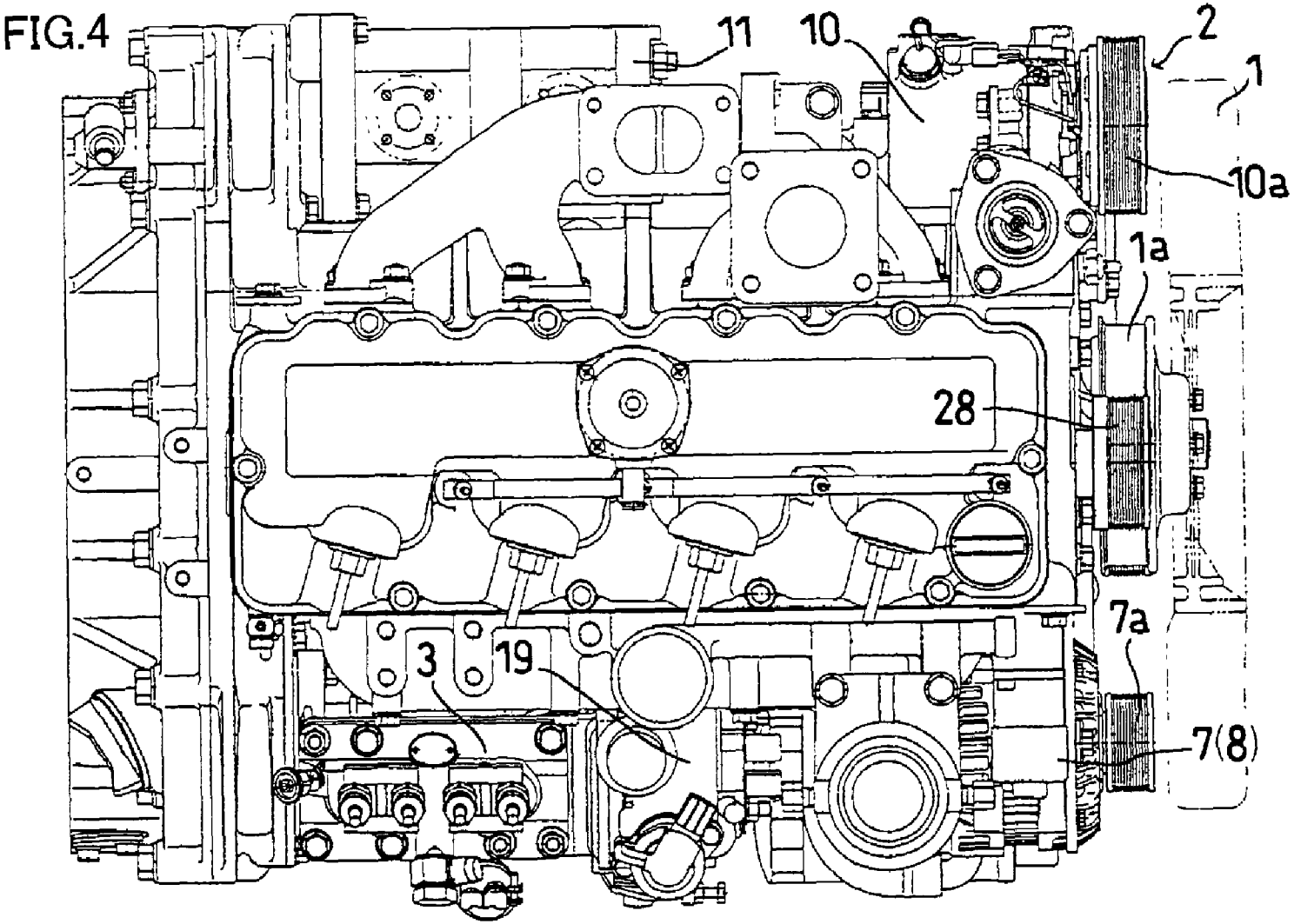
FIG. 4 is a plan view of the engine of FIG. 1.

As shown in FIG. 3, a tension pulley 7*a* of the belt tensioner 7 and a driven pulley 10*a* of the working device 10 are dividedly arranged leftwards and rightwards of a cooling fan pulley 1*a*, respectively. Disposed downwards of the cooling fan pulley 1*a* is a driving pulley 13*a* attached to a crank shaft 13. A fan belt 1*b* is wound around the driving pulley 13*a*, the tension pulley 7*a* and the driven pulley 10*a* so that its inner peripheral surface contacts them. The fan belt 1*b* is wound around the cooling fan pulley 1*a* so that its outer peripheral surface contacts the latter. A cooling water introduction pipe 14*a* of a water pump 14 is arranged between the driven pulley 10*a* and the driving pulley 13*a*. In this first embodiment, the fan belt 1*b* partly returns toward the cooling fan pulley 1*a* between the driven pulley 10*a* and the driving pulley 13*a*. The return portion 1*c* is wound around the cooling fan pulley 1*a*. An idle pulley 28 is arranged upwards of the cooling fan pulley 1*a*. The fan belt 1*b* is partly lifted up between the tension pulley 7*a* and the driven pulley 10*a* and is wound around the idle pulley 28 so that its inner peripheral surface contacts the latter in order for this lifted-up portion not to contact the cooling fan pulley 1*a*. Utilized for the fan belt 1*b* is a poly V belt provided on its inner peripheral surface along a longitudinal direction with a plurality of mountain-like projections.

Figure 5:
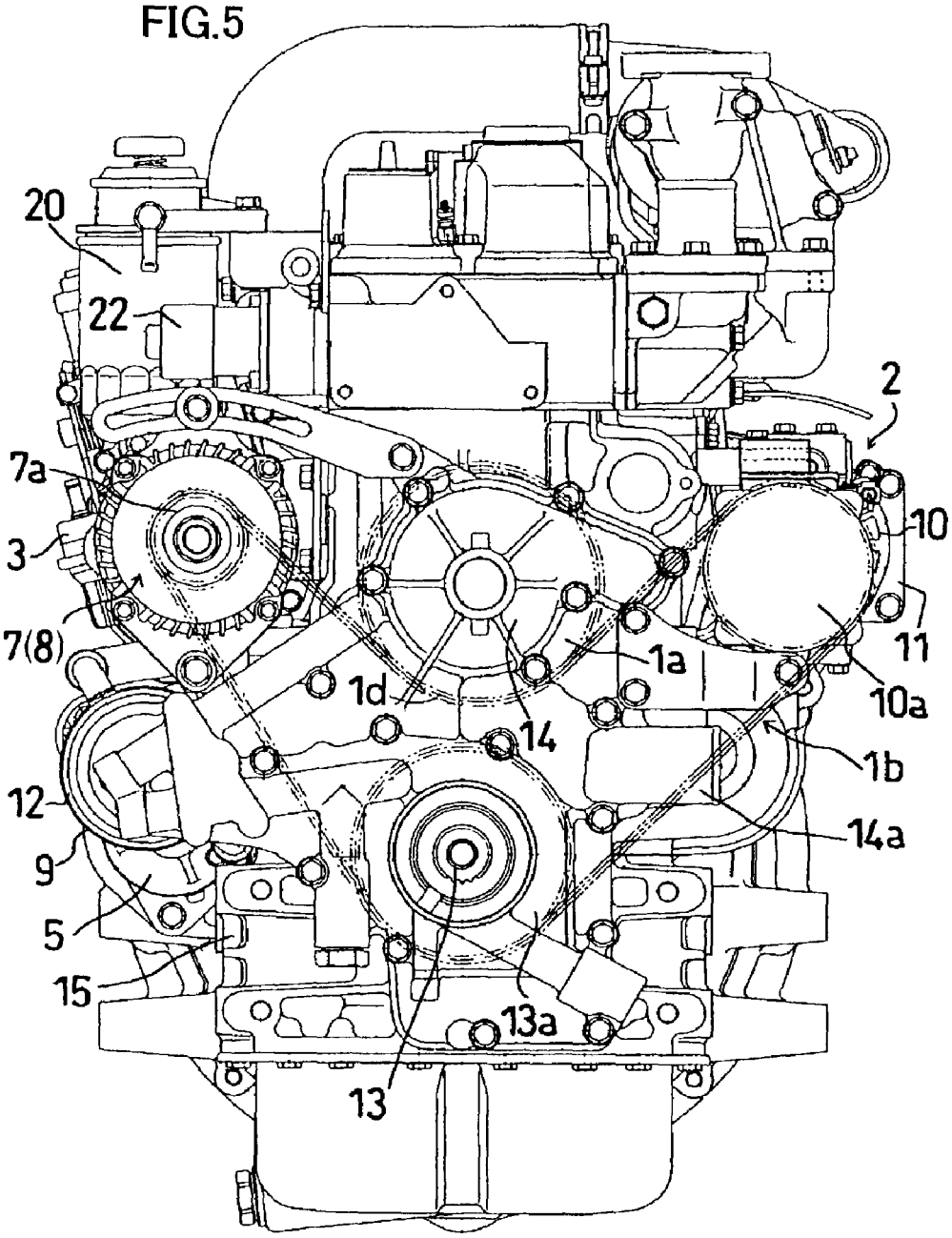
FIG. 5 is a front view of an engine according to a second embodiment.

A second embodiment shown in FIG. 5 is constructed as follows.

The engine of the second embodiment differs from that of the first embodiment in view of the manner in which the fan belt 1*b* of the belt transmission device 2 is wound. The fan belt 1*b* partly returns towards the cooling fan pulley 1*a* between the tension pulley 7*a* and the driven pulley 10*a*. The return portion 1*d* is wound around the cooling fan pulley 1*a*. This winding state does not require the idle pulley 28. The other construction is the same as that of the first embodiment. In FIG. 5, the same elements as those of the first embodiment are designated by the same characters.

What is claimed is:

1. An engine comprising a belt transmission device (2) which interlockingly operates a cooling fan (1) and a timing transmission device (4) which interlockingly actuates a fuel injection pump (3), wherein the belt transmission device (2) and the timing transmission device (4) are dividedly arranged at a front end and a rear end of a cylinder block (6), respectively, and the fuel injection pump (3) is disposed on one horizontal side of the cylinder block (6), a belt tensioner (7) of the belt transmission device (2) being arranged in front of the fuel injection pump (3), an oil cooler (9) and a starter motor (5) are dividedly disposed in a front and rear direction on one horizontal side of a mid portion (6*b*) of the cylinder block (6) in a vertical direction.

2. The engine as set forth in claim 1, wherein when seen from a lateral side of the cylinder block (6), a handle of an oil level gauge (16) is arranged between an oil filter (12) attached to the oil cooler (9) and the starter motor (5).

3. An engine comprising a belt transmission device (2) which interlockingly operates a cooling fan (1) and a timing transmission device (4) which interlockingly actuates a fuel injection pump (3), wherein the belt transmission device (2) and the timing transmission device (4) are dividedly arranged at a front end and a rear end of a cylinder block (6), respectively, and the fuel injection pump (3) is disposed on one horizontal side of the cylinder block (6), a belt tensioner (7) of the belt transmission device (2) being arranged in front of the fuel injection pump (3), a pair of working devices (10) and (11) are dividedly arranged in the front and rear direction on the other horizontal side of the cylinder block (6).

4. The engine as set forth in claim 3, wherein the pair of working devices (10), (11) are arranged on the other horizontal side of the upper side portion (6*a*) of the cylinder block (6).

5. An engine comprising a belt transmission device (2) which interlockingly operates a cooling fan (1) and a timing transmission device (4) which interlockingly actuates a fuel injection pump (3), wherein the belt transmission device (2) and the timing transmission device (4) are dividedly arranged at a front end and a rear end of a cylinder block (6), respectively, and the fuel injection pump (3) is disposed on one horizontal side of the cylinder block (6), a belt tensioner (7) of the belt transmission device (2) being arranged in front of the fuel injection pump (3), wherein the fuel injection pump (3) is arranged on one horizontal side of an upper side portion (6*a*) of the cylinder block (6);

an oil cooler (9) and a starter motor (5) are dividedly disposed in a front and rear direction on one horizontal side of a mid portion (6*b*) in a vertical direction of the cylinder block (6); and a pair of working devices (10), (11) are dividedly arranged in the front and rear direction on the other horizontal side of the upper side portion (6*a*) of the cylinder block (6).

6. An engine comprising a belt transmission device (2) which interlockingly operates a cooling fan (1) and a timing transmission device (4) which interlockingly actuates a fuel injection pump (3), wherein the belt transmission device (2) and the timing transmission device (4) are dividedly arranged at a front end and a rear end of a cylinder block (6), respectively, and the fuel injection pump (3) is disposed on one horizontal side of the cylinder block (6), a belt tensioner (7) of the belt transmission device (2) being arranged in front of the fuel injection pump (3), a tension pulley (7*a*) of the belt tensioner (7) and a driven pulley (10*a*) are dividedly arranged on both horizontal sides of a cooling fan pulley (1*a*), and a driving pulley (13*a*) is arranged downwards of the cooling fan pulley (1*a*), a fan belt (1*b*) being wound around the driving pulley (13*a*), the tension pulley (7*a*) and the driven pulley (10*a*) so that its inner peripheral surface contacts with them, the fan belt (1*b*) being wound around the cooling fan pulley (1*a*) so that its outer peripheral surface contacts with the latter.

7. The engine as set forth in claim 6, wherein when disposing a cooling water introduction pipe (14*a*) of a water pump (14) between the driven pulley (10*a*) and the driving pulley (13*a*), the fan belt (1*b*) partly returns toward the cooling fan pulley (1*a*) between the driven pulley (10*a*) and the driving pulley (13*a*), and the return portion (1*c*) is wound around the cooling fan pulley (1*a*).

8. The engine as set forth in claim 6, wherein the fan belt (1*b*) partly returns toward the cooling fan pulley (1*a*) between the tension pulley (7*a*) and the driven pulley (10*a*) and the return portion (1*d*) is wound around the cooling fan pulley (1*a*).

* * * * *